US006584925B2

(12) United States Patent
Kapsner et al.

(10) Patent No.: US 6,584,925 B2
(45) Date of Patent: Jul. 1, 2003

(54) DEVICE AND METHOD FOR HANDLING A BOAT WINDSHIELD

(75) Inventors: Kevin John Kapsner, Little Falls, MN (US); Gregory Herman Rohr, Little Falls, MN (US)

(73) Assignee: Larson/Glastron Boats, Inc., Minneapolis, MN (US)

( * ) Notice: Subject to any disclaimer, the term of this patent is extended or adjusted under 35 U.S.C. 154(b) by 0 days.

(21) Appl. No.: 10/028,612

(22) Filed: Dec. 21, 2001

(65) Prior Publication Data

US 2002/0178991 A1 Dec. 5, 2002

Related U.S. Application Data

(60) Provisional application No. 60/257,327, filed on Dec. 21, 2000.

(51) Int. Cl.[7] ..... B63B 17/00

(52) U.S. Cl. ..... 114/361; 269/21; 414/737; 414/752.1

(58) Field of Search ..... 269/21; 414/737, 414/752.1; 114/361

(56) References Cited

U.S. PATENT DOCUMENTS 3,598,263 A * 8/1971 Ehmke ..... 294/65
3,620,524 A * 11/1971 Czompi ..... 156/391
3,765,550 A * 10/1973 Tausheck ..... 414/11
4,676,713 A * 6/1987 Voelpel ..... 414/590
4,750,449 A * 6/1988 Muhlberger ..... 114/361
5,664,519 A * 9/1997 Erskine ..... 114/361

FOREIGN PATENT DOCUMENTS

FR 2756549 * 6/1998

* cited by examiner

*Primary Examiner*—Sherman Basinger
(74) *Attorney, Agent, or Firm*—Merchant & Gould P.C.

(57) ABSTRACT

An articulated arm attachment for use in handling a boat windshield. The attachment includes an elongated vertical member including a top end and a bottom end. The top end of the vertical member is adapted for connection to the articulated arm. The attachment also includes a windshield holding assembly having a suction device for holding the windshield via vacuum pressure. The suction device is connected to a mounting structure that is positioned adjacent to the bottom end of the vertical member. The mounting structure is pivotally moveable relative to the vertical member about a horizontal axis. The attachment further includes a catch member connected to the mounting structure for catching the windshield if the windshield accidentally disengages from the suction device.

2 Claims, 5 Drawing Sheets

DEVICE AND METHOD FOR HANDLING A BOAT WINDSHIELD

PRIORITY OF INVENTION

This application claims priority of invention under 35 U.S.C. §119(e) from U.S. Provisional application No. 60/257,327, filed Dec. 21, 2000, the disclosure of which is incorporated by reference herein.

FIELD OF THE INVENTION

The present invention relates generally to devices and methods for assembling products such as boats. More particularly, the present invention relates to devices and methods for handling boat windshields.

BACKGROUND OF THE INVENTION

Conventional boat manufacturing processes are typically quite labor intensive and involve a significant amount of manual lifting and positioning of component parts. What are needed are methods and devices for improving manufacturing efficiency on a boat assembly line.

SUMMARY OF THE INVENTION

One aspect of the present invention relates to an articulated arm attachment for use in handling a boat windshield. The attachment includes an elongated vertical member including a top end and a bottom end. The top end of the vertical member is adapted for connection to the articulated arm. The attachment also includes a windshield holding assembly having a suction device for holding the windshield via vacuum pressure. The suction device is connected to a mounting structure that is positioned adjacent to the bottom end of the vertical member. The mounting structure is pivotally moveable relative to the vertical member about a horizontal axis. The attachment further includes a catch member connected to the mounting structure for catching the windshield if the windshield inadvertently disengages from the suction device.

Another aspect of the present invention relates to a device for handling a boat windshield. The device includes an articulated boom and an elongated member that extends downwardly from the boom. The device also includes a windshield holding assembly including a suction device for holding the windshield via vacuum pressure. The suction device is connected to a mounting structure that is positioned adjacent to a bottom end of the elongated member. The device further includes a hook structure for catching the windshield if the windshield inadvertently disengages from the suction device.

A further aspect of the present invention relates to a method for mounting a windshield on a boat. The method includes affixing a suction device to the windshield; lifting the suction device with the windshield affixed thereto; and positioning a catch member beneath the windshield to catch the windshield if the windshield disengages from the suction device while the windshield is being lifted. The method also includes positioning the suction device with the windshield affixed thereto over the boat; lowering the suction device and the affixed windshield toward the boat; and connecting the windshield to the boat.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawings in which identical elements are numbered identically throughout, a description of various exemplary aspects of the present invention will now be provided.

Figure 1:
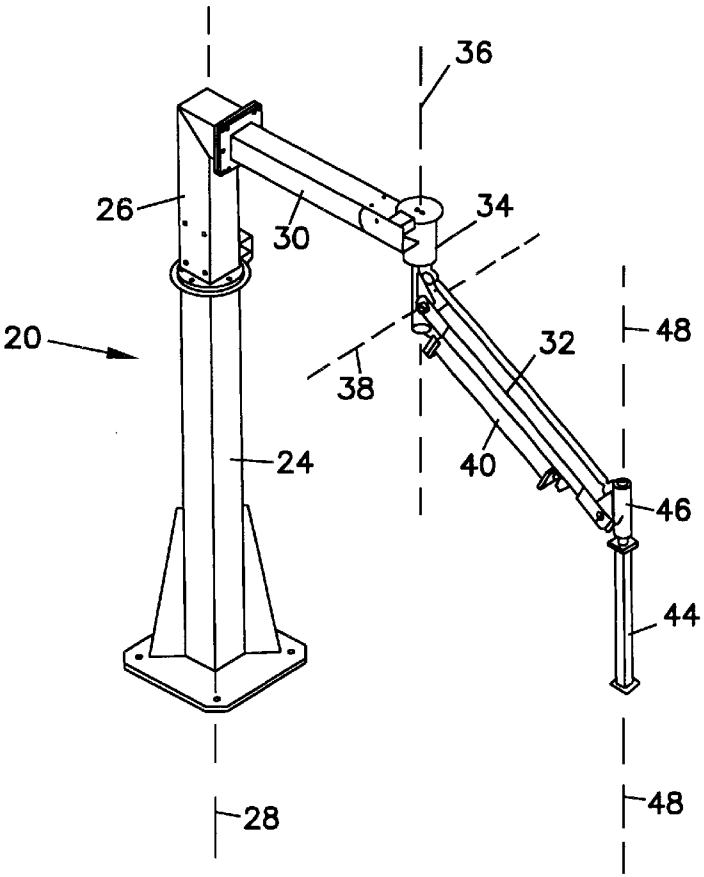
FIG. 1 is a perspective view of an articulated arm/boom suitable for use with an attachment constructed in accordance with the principles of the present invention.
Figure 2:
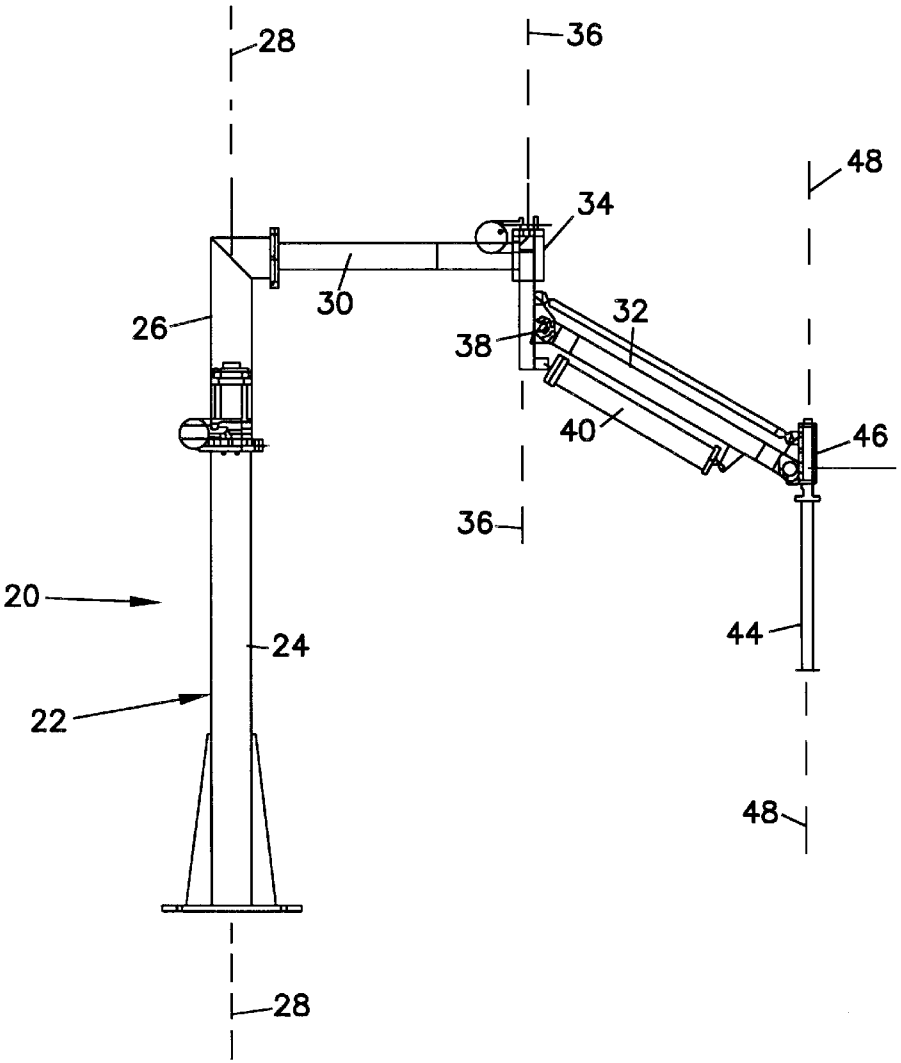
FIG. 2 is a side view of the articulated arm/boom of FIG. 1.

FIGS. 1 and 2 show an articulated boom 20 (i.e., a jib or crane) suitable for use with a windshield handling attachment constructed in accordance with the principles of the present invention. The articulated boom 20 includes a main post 22 having a base piece 24 and an upper extension 26. The upper extension 26 is free to pivot about a vertical axis 28 that extends longitudinally through the main post 22. A first arm 30 projects outwardly from the upper extension 26 in a cantilevered fashion. The far end of the first arm 30 is connected to a second arm 32 by a pivot mount 34. The pivot mount 34 allows the second arm 32 to pivot relative to the first arm 30 about a vertical axis 36. The second arm 32 is also mounted to pivot about a horizontal axis 38. A cylinder 40 (e.g., a pneumatic cylinder) is provided for pivoting the second arm 32 about the horizontal axis 38. For example, by extending the cylinder 40, the second arm 32 is pivoted upwardly thereby lifting the far end of the second arm 32. By retracting the cylinder 40, the second arm 32 is pivoted downwardly thereby lowering the far end of the second arm 32. It will be appreciated that articulated booms as described above are conventionally known in the art. For example, similar booms are manufactured and sold by GCI Company of Garfield, Minn.

A windshield handling attachment 42 constructed in accordance with the principles of the present invention is preferably connected to the far end of the second arm 32. It will be understood that the phrase "connected to" includes direct connections as well as connections made by intermediate pieces or structures. As shown in FIGS. 1 and 2, only a portion of the attachment 42 is depicted. Specifically, only an elongated lift member 44 (e.g., a length of square, steel tubing) is shown. The lift member 44 is aligned in a vertical orientation. An upper end of the lift member 44 is connected to the far end of the second arm 32 by a pivot mount 46. The pivot mount 46 allows the lift member 44 to pivot relative to the second arm 32 about an axis 48 that extends longitudinally through the lift member 44.

Figure 3A:
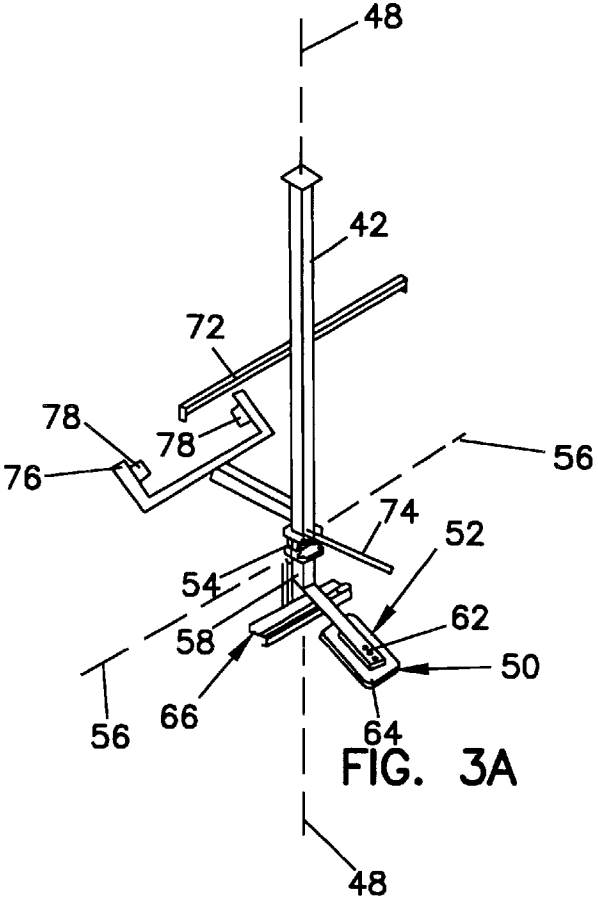
FIG. 3A is a perspective view of an articulated boom attachment constructed in accordance with the principles of the present invention.
Figure 3B:
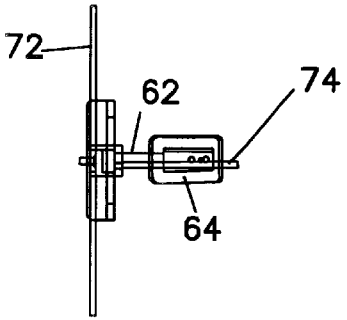
FIG. 3B is a top view of the attachment of FIG. 3A.
Figure 3C:
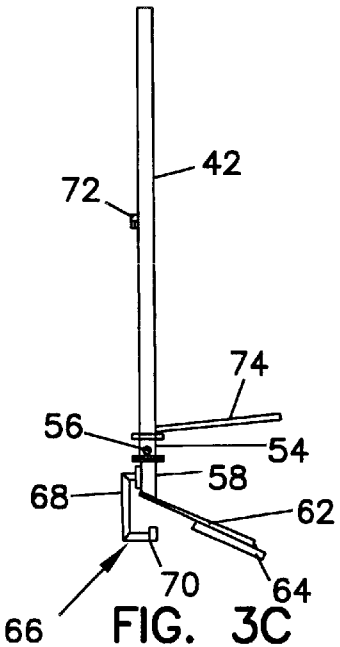
FIG. 3C is a side view of the attachment of FIG. 3A.

Referring to FIGS. 3A–3C, the attachment 42 also includes a windshield holding assembly for holding the windshield via vacuum pressure. The holding assembly includes a suction device 50 adapted to be selectively affixed to the windshield via vacuum pressure. The suction device 50 is connected to a mounting structure 52 that is positioned adjacent to a bottom end of the lift member 44. The mounting structure 52 is connected to the bottom end of the lift member 44 by a pivot mount 54. The pivot mount 54 allows the mounting structure 52 to pivot about an axis 56 that is transversely oriented relative to the lift member 44. The phrase "transversely oriented" will be understood to mean that the axis 56 extends cross-wise relative to the lift member 44. As shown in FIG. 3A, the axis 56 is horizontal.

Figure 4:
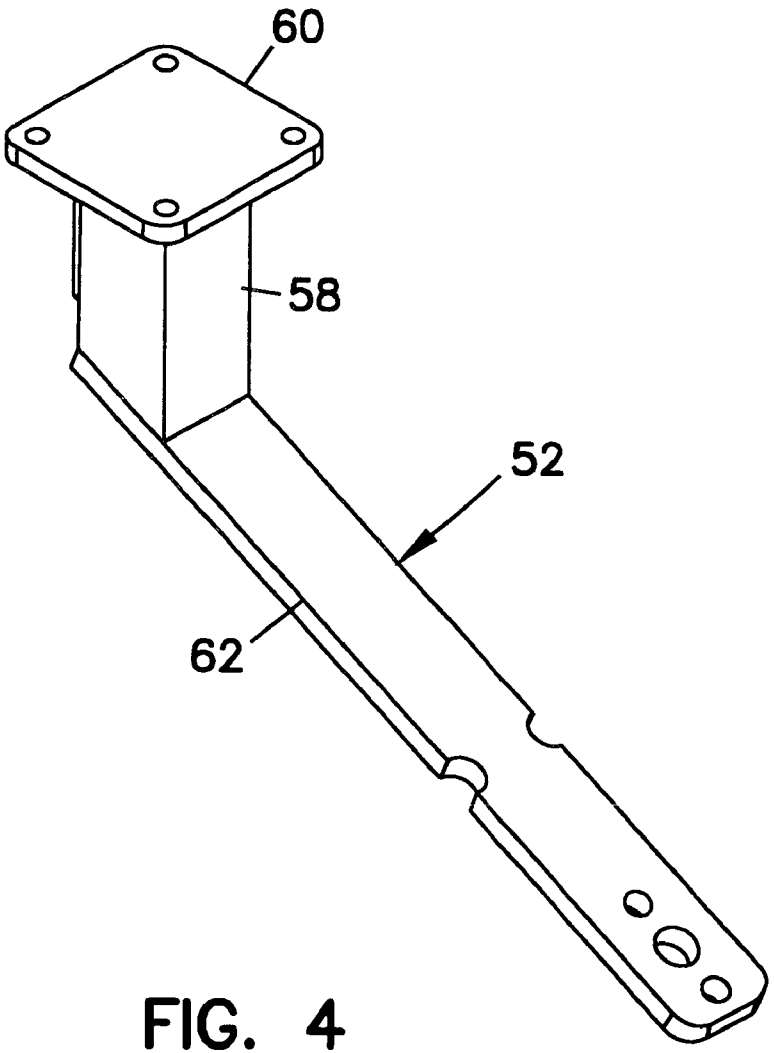
FIG. 4 is a perspective view of a suction device mounting structure used by the attachment of FIGS. 3A–3C.

Referring to FIG. 4, the mounting structure 52 includes a vertical extension 58 (e.g., a piece of square, steel tubing). A mounting flange 60 is connected to the top end of the vertical extension 58 for allowing the mounting structure 52 to be connected to the pivot mount 54 by conventional techniques (e.g., fasteners such as bolts, screws, rivets, etc.). A lateral extension 62 is connected to the bottom end of the vertical extension 58. The lateral extension 62 is angled relative to the vertical extension 58 so as to extend downwardly and radially outwardly from the vertical extension 58. As best shown in FIGS. 3A and 3C, the suction device 50 is connected to the lateral extension 62. For example, a suction cup 64 (e.g., a vinyl cup) is connected to the underside of the lateral extension 62. Preferably, vacuum pressure is provided to the cup 64 by a vacuum pump (not shown) mounted on the upper side of the lateral extension 62. The vacuum pump is preferably driven by a compressor (not shown) connected to the vacuum pump by conventional techniques (e.g., pneumatic hoses and suitable valving).

Referring again to FIGS. 3A–3C, the attachment 42 also includes a catch member 66 for catching the windshield if the windshield inadvertently disengages from the suction device 50. As shown in FIGS. 3C, the catch member 66 has an L-shaped or hook-like configuration. For example, the catch member 66 includes a shank portion 68 that is connected to the vertical extension 58 of the mounting structure 52 (e.g., by fasteners). The catch member 66 also includes a hook portion 70 that extends laterally outwardly from the shank portion 68 to a location preferably at least partially beneath the lateral extension 62 of the mounting structure 52.

Referring still to FIGS. 3A–3C, the attachment 42 further includes a crossbar 72 connected to a mid-region of the lift member 42, and a door stop/rest 74 connected to a lower region of the lift member 42. The crossbar 72 is preferably aligned in a horizontal orientation, while the doorstop 74 is preferably angled slightly upward. Preferably, the doorstop 74 comprises a rod that extends directly above the lateral extension 62 of the mounting structure 52. As best shown in FIG. 3B, the crossbar 72 is rotationally offset 90 degrees relative to the door stop 74.

The attachment 42 additionally includes a handle 76 (shown only in FIG. 3A) connected to the lift member 42. Preferably, the handle 76 extends outwardly from the lift member 42 in a direction opposite from the doorstop 74. Controls 78 for extending and retracting the lift cylinder 40, and for activating and deactivating the suction device 50 are preferably provided on the handle. To enhance the ergonomics of the attachment, the height of the handle 76 is preferably adjustable.

Figure 5:
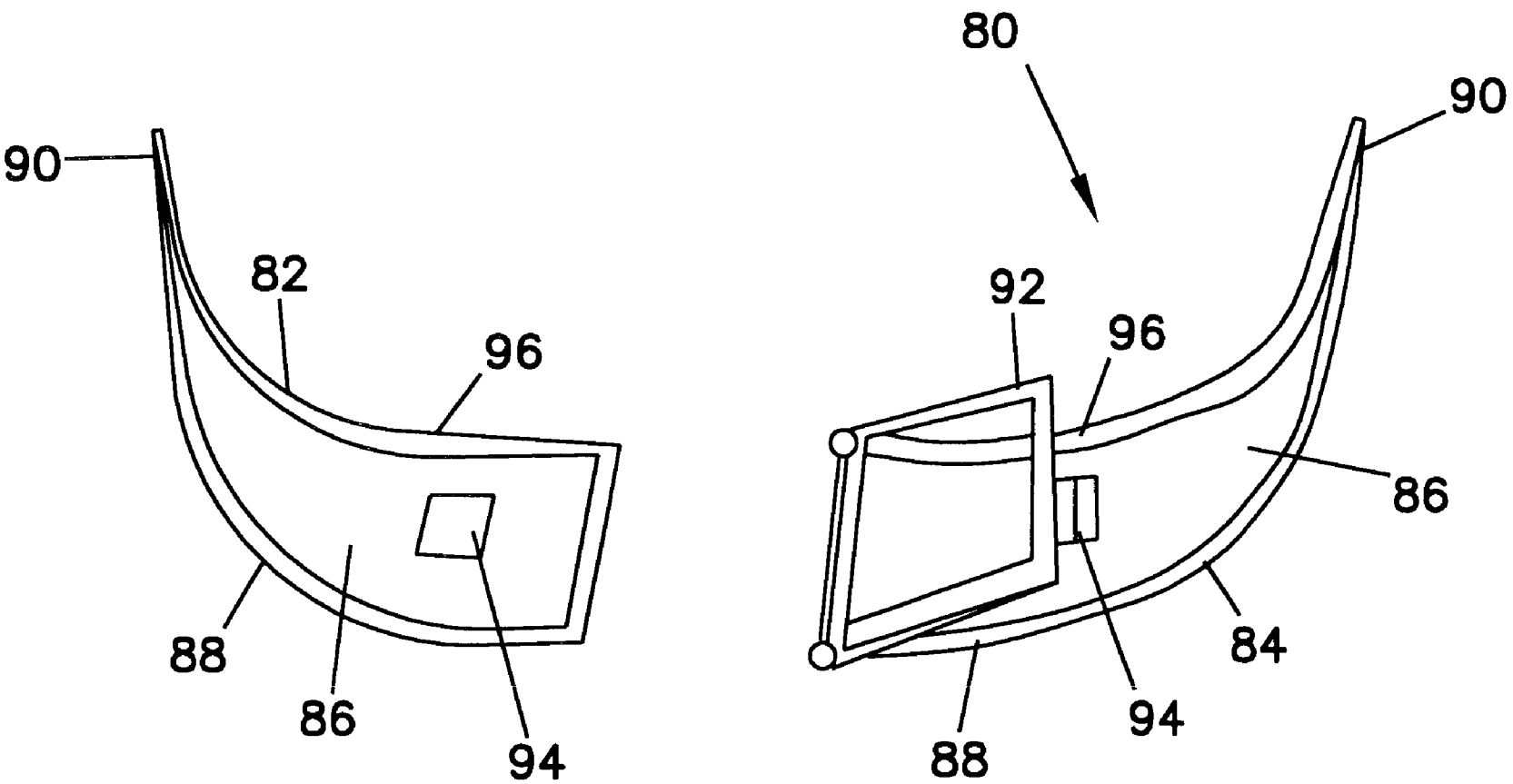
FIG. 5 is a perspective view of a boat windshield.

FIG. 5 shows a boat windshield 80 which is an example of the type of structure the attachment 42 is adapted for handling. The windshield 80 includes separate first and second pieces 82 and 84. The first and second pieces 82 and 84 each include a transparent shield portion 86 (e.g., glass) supported by a frame 88 (e.g., aluminum) surrounding the perimeter of the shield portion 86. Each of the frames 88 includes a rearward extension 90. The second piece 84 includes a hinged door 92 used to open and close a gap or walkway between the two pieces 82 and 84.

Figure 6:
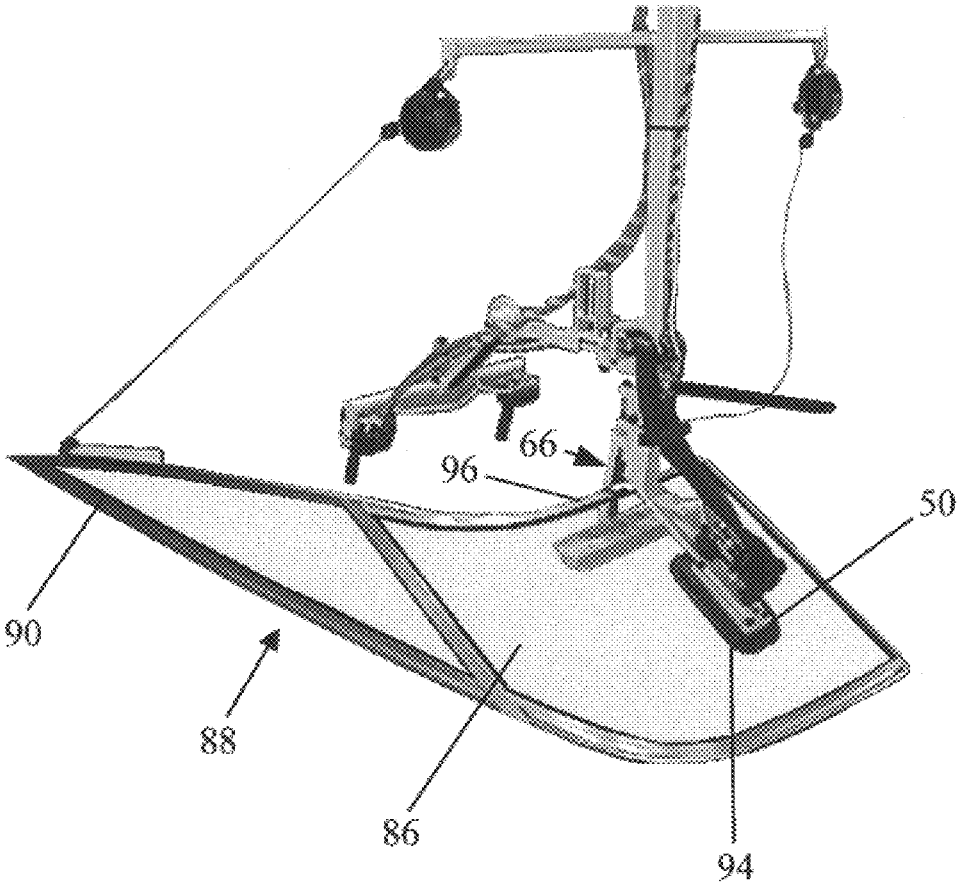
FIG. 6 shows the boom attachment of FIG. 3A being used to lift a part of a windshield.

To handle the first piece 82, the suction device 50 is affixed to the outer surface of the shield portion 86 by vacuum pressure. For example, the suction device 50 can be affixed at location 94 shown in FIGS. 5 and 6. As so affixed, a top region 96 of the frame 88 is preferably positioned directly over the hook portion 70 of the catch member 66. To assist in stabilizing the first piece 82 a retractable cable 83 (shown in FIG. 6) or other structure (e.g., a rope or chain) can be connected to the cross-bar 72 of the attachment 42 and secured to the rearward extension 90 of the frame 88. During lifting, the cable and the catch member 66 prevent the piece 82 from falling if the suction device 50 disengages from the shield portion 86 (e.g., if the shield portion 86 breaks). For example, if the suction device 50 does disengage from the first piece 82, the top region 96 of the frame 88 catches on the hook portion 70 of the catch member 66, and the cable 83 prevents the first piece 82 from twisting off the catch member 66.

Once the attachment 42 is connected to the first piece 82, the cylinder 40 is extended to lift the first piece 82. As the first piece 82 is lifted, the pivot mount 54 allows the windshield to pivot via gravity until a stop is contacted. Once lifted, an operator can manually move the first piece 82 to a location directly above a desired mounting location on a boat. Next, the cylinder 40 is retracted to lower the first piece 82 to the desired mounting position. With the first piece 82 in the desired mounting position, the attachment 42 can be disconnected from the first piece 82 by deactivating the suction device 50, and by removing the cable from the rearward extension 90. Thereafter, the first piece 82 can be fastened or otherwise connected to the boat by conventional techniques.

After the first piece 82 is connected to the boat, the operator can repeat the above-described process to connect the second piece 84 to the boat. To prevent the hinged door 92 from interfering with the handling process, as the second piece 84 is lifted, the door is preferably pivoted toward an open position and rested against the doorstop 74. Otherwise, the second piece 84 is handled in the same manner as the first piece 82.

While the present invention has been described in terms of an attachment for handing a boat windshield, it should be understood that the invention has potential applications in other industries. For example, the invention could be utilized in the automotive industry for the handling of windshields to be mounted onto automobiles or in the aeronautic industry for the handling of windshields to be mounted onto airplanes.

The above specification and examples provide a complete description of the manufacture and use of the composition of the invention. Since many embodiments of the invention can be made without departing from the spirit and scope of the invention, the invention resides in the claims hereinafter appended.

What is claimed is:

1. A method for mounting a windshield on a boat, the method comprising:

affixing a device to the windshield;

lifting the device with the windshield affixed thereto;

positioning a catch member beneath the windshield to catch the windshield if the windshield disengages from the device while the windshield is being lifted;

positioning the device with the windshield affixed thereto over the boat;

lowering the device and the affixed windshield toward the boat;

connecting the windshield to the boat; and further comprising stabilizing at least a portion of the windshield with a cable that prevents the windshield from separating from the catch member should the windshield become disengaged from the device.

2. A method for mounting a windshield on a boat, the method comprising:

affixing a device to the windshield;

lifting the device with the windshield to catch the windshield if the windshield disengages from the device while the windshield is being lifted;

positioning the device with the windshield affixed thereto over the boat; lowering the device and the affixed windshield toward the boat;

connecting the windshield to the boat; and further comprising supporting a hinged door of the windshield with a door rest as the windshield is lifted.

* * * * *

UNITED STATES PATENT AND TRADEMARK OFFICE

CERTIFICATE OF CORRECTION

PATENT NO. : 6,584,925 B2
DATED : July 1, 2003
INVENTOR(S) : Kapsner et al.

It is certified that error appears in the above-identified patent and that said Letters Patent is hereby corrected as shown below:

Column 6,
Lines 4-6, "lifting the device with the windshield to catch the windshield if the windshield disengages from the device while the windshield is being lifted;" should read
-- lifting the device with the windshield affixed thereto;
positioning a catch member beneath the windshield to catch the windshield if the windshield disengages from the device while the windshield is being lifted; --;
Line 8, "lowering the device" should start a new paragraph Signed and Sealed this Twenty-seventh Day of January, 2004

JON W. DUDAS
*Acting Director of the United States Patent and Trademark Office*